United States Patent [19]

Lowell

[11] 4,130,280

[45] Dec. 19, 1978

[54] GAME APPARATUS

[76] Inventor: Joseph Lowell, 139 Sutro Heights Ave., San Francisco, Calif. 94121

[21] Appl. No.: 862,267

[22] Filed: Dec. 20, 1977

[51] Int. Cl.[2] ..... A63F 7/06

[52] U.S. Cl. ..... 273/87.2; 273/122 A; 273/125 A

[58] Field of Search ..... 273/87, 87.2, 87.4, 273/119 A, 120 A, 121 A, 122 A, 123 A, 124 A, 125 A, 176 FA, 176 H

[56] References Cited

U.S. PATENT DOCUMENTS

| | | | |
|---|---|---|---|
| 1,866,821 | 7/1932 | Rather | 273/125 A |
| 1,951,973 | 3/1934 | Fuld | 273/121 A |
| 2,259,916 | 10/1941 | Wheeler et al. | 273/123 A X |
| 3,114,554 | 12/1963 | Hurley | 273/176 FA |
| 3,140,093 | 7/1964 | Singer | 273/125 A X |

*Primary Examiner*—Paul E. Shapiro

*Attorney, Agent, or Firm*—Townsend and Townsend

[57] ABSTRACT

A device for playing a game, such as a simulated golf game, wherein the object is to place a ball in a series of holes in the least number of shots. Playing balls equal in number to a preselected number of players and having electrically conductive surfaces, complete an electrical circuit after they all have been successfully played through an open hole to automatically close that hole, open the next hole, and return the played balls for replay at the next hole.

11 Claims, 5 Drawing Figures

GAME APPARATUS

BACKGROUND OF THE INVENTION

The present invention relates to a device for playing a game, such as a simulated golf game, in which the object of the game is to record the least number of strokes or shots required to place a ball into a series of holes. More specifically, the invention relates to such a game device which enables preselection of a number of players, automatic closure of the played hole and opening of the next hole in the series, and automatic return of the played balls after the last player has successfully shot a ball through the opened hole.

Prior golf simulation games in which an entire golf course, or at least a series of holes, appears on a relatively small game board or playing surface possess the inherent problem of presenting only one hole at a time to the player. Because of the small scale on which the game is played, holes other than the target hole thus present hazards in the way of a player's shot toward the target hole.

This problem is further complicated by an additional factor, namely that golf is normally played by a variable number of players, usually one to four, who shoot at the holes in succession. Thus, prior game devices have been unable to accommodate a variable number of players who take turns shooting their respective balls into the same hole before then taking aim at the next hole on the course.

U.S. Pat. No. 3,458,195 avoids rather than solves these two specific problems. The disclosure in U.S. Pat. No. 3,458,195 is a golf game device which does not simulate the actual game of golf. First, the game device is restricted to play by a foursome rather than a variable number of players. Secondly, each of the players shoots at his own particular course consisting of four holes, thus avoiding the problem of other openings on the game board presenting hazards to the particular shooter.

SUMMARY OF THE INVENTION

The present invention relates to a game device which solves these prior art problems by presenting only one hole at a time to be played by a variable number of players, for example, one to four, and in which after the last of the players has played, that hole is automatically closed and the next hole on the course is then presented for play.

The game device consists of an inclined playing surface containing a series of holes and a ball propelling mechanism at the lower portion of the playing surface. Each of the holes has within it a weighted closure device which is connected to the underside of the playing surface by a hinge mechanism. A platform capable of being rotated is connected to the underside of the playing surface and in close proximity to the underside to support the closure devices in a normally closed position. The rotating platform contains an opening larger than any one of the holes to selectively permit one of the closure members to fall into an open position when the opening on the rotating platform is located directly below that particular hole. Thus, at any one time only one hole in the series, or on the course if the game is meant to simulate a golf game, is presented for play.

The game device has a switch which permits the number of players to be selected before play begins. The switch is preferably a rotary switch which is electrically connected to plates on a ball return channel located beneath the playing surface. The plates are arranged in pairs and define spaces to be filled by one or more of the balls after they have passed through the opened hole and down to the ball return channel. The balls have electrically conductive surfaces so that when the number of balls corresponding to the number of preselected players has passed through the opened hole and into the ball return channel, an electrical circuit is completed. The completion of the electrical circuit permits current to flow simultaneously to a drive motor connected to the platform and to a solenoid connected to a gate at the exit of the ball return channel. The drive motor rotates the platform to automatically close the played hole. The solenoid is activated to release the played balls for replay at the new hole. Rotation of the platform is automatically stopped when the opening on the disk is below the next hole on the course.

Thus, the present invention allows a variable number of players to play a series of holes in sequence. By the automatic closure of a hole after it has been played by the last of a preselected number of players and the subsequent automatic opening of the next hole in the series, the playing of the game is not hindered by the hazards presented by other holes in the series being open. The game device works equally well regardless of the number of players since it is the number of electrically conductive balls which lie in the ball return channel which determines when the rotating disk will advance to present the next hole for play.

DESCRIPTION OF THE PREFERRED EMBODIMENT

Figure 1:
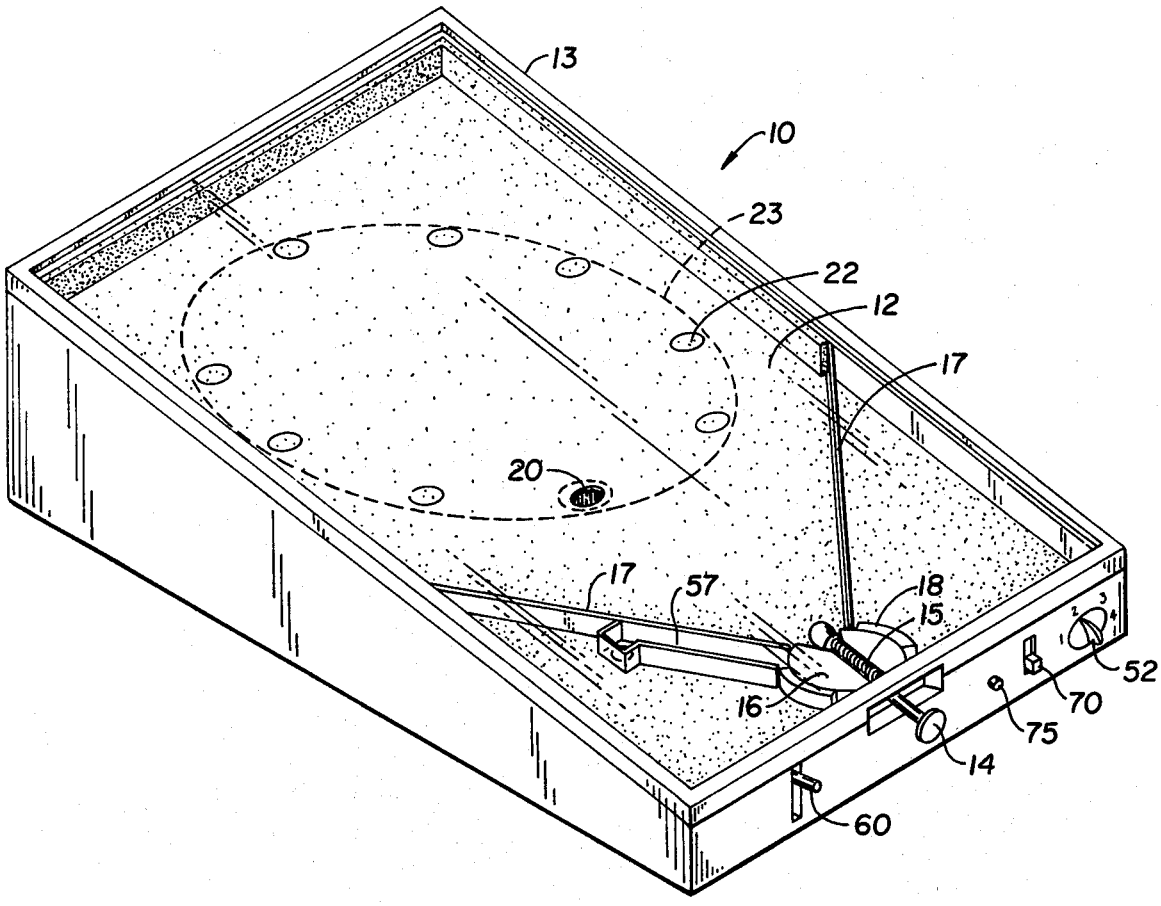
FIG. 1 is an overall view of the game device.

The game device 10 illustrated in FIG. 1 generally consists of an inclined playing surface 12 recessed within a support structure 13. Located on the playing surface are a series of openings which may represent for example, the holes of a golf course. At the lower end of the playing surface is a mechanism 14 for propelling the ball up the inclined surface towards the opened hole. The propelling mechanism 14, is preferably a rod activated by spring 15. A device for aiming the propelling mechanism, such as disk 16 located within suitably shaped side walls 18 permits the ball to be aimed at any one of the holes.

Figure 2:
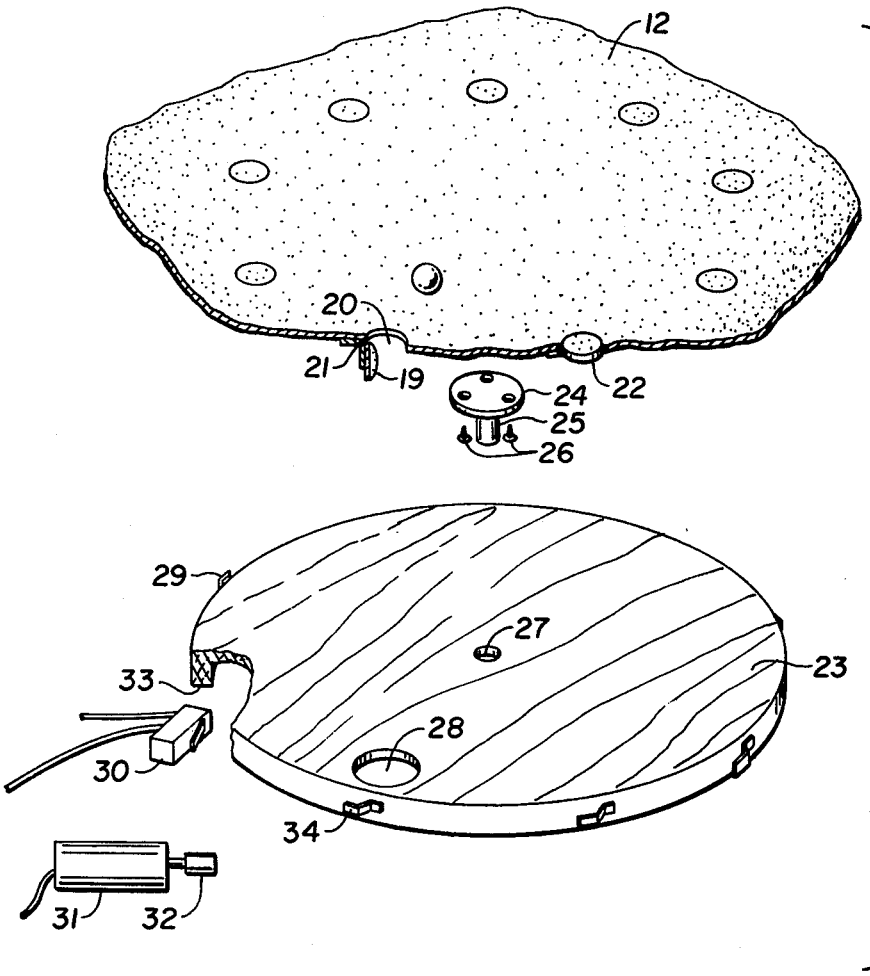
FIG. 2 is an exploded view illustrating the disk located beneath the playing surface.
Figure 5:
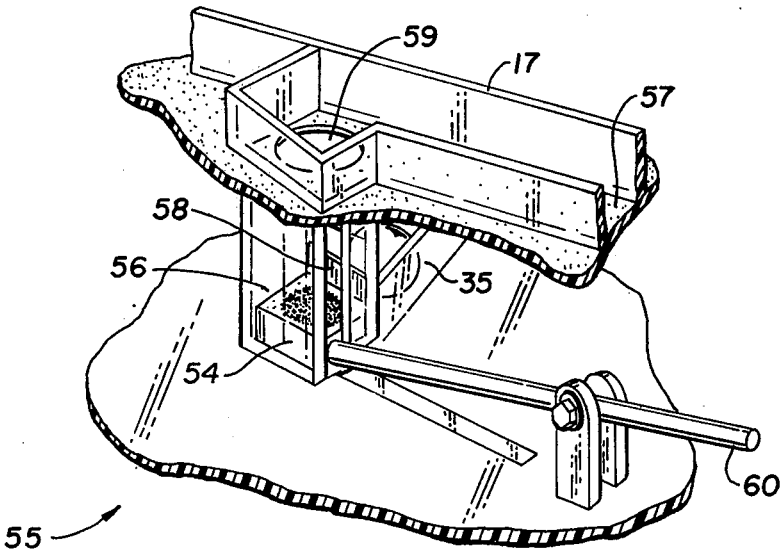
FIG. 5 is a cutaway view of the ball lifting mechanism.

As shown in FIG. 1, there are nine holes arranged in a circle on the playing surface. Each of these holes has associated with it a weighted cover member, such as cover member 19 associated with aperture 20, as shown in FIG. 2. Each of the cover members is connected to the lower side of the playing surface by a hinge mechanism, such as hinge 21. Because the cover members are weighted, they will fall into an open position, as shown by cover member 19, unless supported in a closed position. When in the closed position, the cover members provide an unimpeded playing surface for the balls directed at the open hole. Cover member 22 is shown in the closed position.

Mounted to the underside of the playing surface substantially at the center of the circle defined by the apertures is a rotatable platform or disk 23. A bracket 24 having a downwardly protruding shaft 25 is mounted to the underside of the playing surface by screws 26. The disk has an opening 27 in the center for mounting on the shaft 25. The disk 23 is secured to the shaft by any suitable means, such as a cotter pin, which permits the disk to rotate freely about the shaft. The disk has an opening 28, substantially larger than any of the apertures on the playing surface. The opening 28 is located at approximately the same radial distance from the center of the circle so as to align with the apertures. Thus, when the disk is rotated such that the hole 28 does not align with any of the apertures, all of the cover members of the apertures will be supported and thus the playing surface will have no open holes. If the disk is rotated so that the opening 28 is aligned with one of the apertures, such as for example, aperture 20, the cover member associated with that aperture will be allowed to fall into the open position, as shown by cover member 19. If the disk is then further rotated in a counterclockwise direction, cover member 19 will be closed by the action of the disk and cover member 22 will fall into the open position when opening 28 is aligned below it. The side walls of the opening 28 may be beveled or otherwise suitably shaped so as to permit the disk to operate smoothly with the cover members. Located around the periphery of the disk are cams, such as cams 29 and 34. These cams cooperate with the switch 30 so as to open an electrical circuit and thus stop the rotation of the disk at the proper point. The disk is rotated by a motor 31 having a drive wheel 32 which acts on the underside 33 of the periphery of the disk.

While in the preferred embodiment the nine holes are arranged in a circle on the playing surface and the opening on the disk is located at substantially the same radial distance from the center of the circle as are the nine holes, it will be noted that the holes could be located at different radial distances and the opening on the disk could be elongated in a radial direction. In such an embodiment, the elongated opening would be able to cooperate with each of the cover members in turn as the disk rotated.

Figure 4:
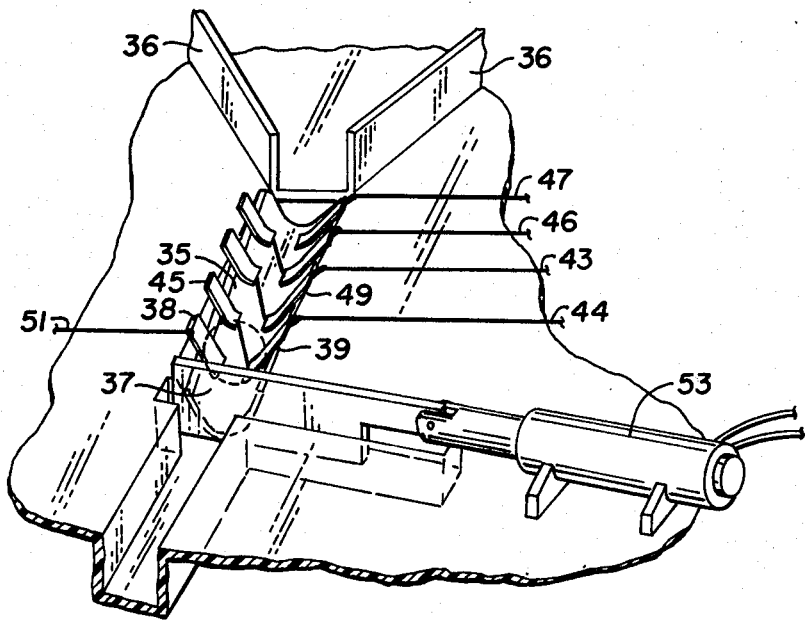
FIG. 4 is a cutaway view illustrating the ball return channel.

A ball return channel 35, as shown in FIG. 4, is located within the support structure 13 and under the playing surface 12. Played balls which have passed through the open hole are guided by ball return guides 36 into the ball return channel. A gate mechanism 37 is located at the lower end of the ball return channel and prevents played balls from further movement down the channel. Within the ball return channels are a series of pairs of electrically conductive plates. Each pair of plates is arranged to define a space for the receipt of one of the electrically conductive balls. Thus, plates 38 and 39 constitute a pair of such plates and define a gap in the circuit between leads 44 and 51. Alternate plates of each pair are electrically coupled to one another, as shown by the electrical connection between plate 39 and plate 45 of the next adjacent pair. Thus, by way of example, if there are two electrically conductive balls lying in the ball return channel, an electrical circuit will be completed from lead 43 to plate 49, across the second of the electrically conductive played balls to plate 45, through the electrical connection between plate 45 and 39, across the first electrically conductive played ball to plate 38, and out to lead 51. Each of the four leads 44, 43, 46 and 47 is connected to a rotary switch 50, shown in FIG. 3.

A ball lifting mechanism 55 returns the played balls to the ball propelling mechanism after they have been released by the movable gate 37. The lifting mechanism comprises essentially a lever 60 attached to a lifting platform 54 for raising the played ball up a shaft 56 through an aperture 59 and up to the playing surface.

A spring-activated ball retaining plate 58 prevents balls from falling into the open shaft 56 when the lifting platform 54 is in the up position. The balls which have been lifted to the surface travel down a channel 57 to the ball propelling mechanism.

The specific features of the present invention will be more fully understood by a description of the game device in operation. Thus, assuming for purposes of illustration that the game is to be played by two players, the rotary switch 50 will be set to accommodate two players by turning dial 52 to the designated numeral "2" as shown in FIG. 1. The game is turned on by power switch 70.

Figure 3:
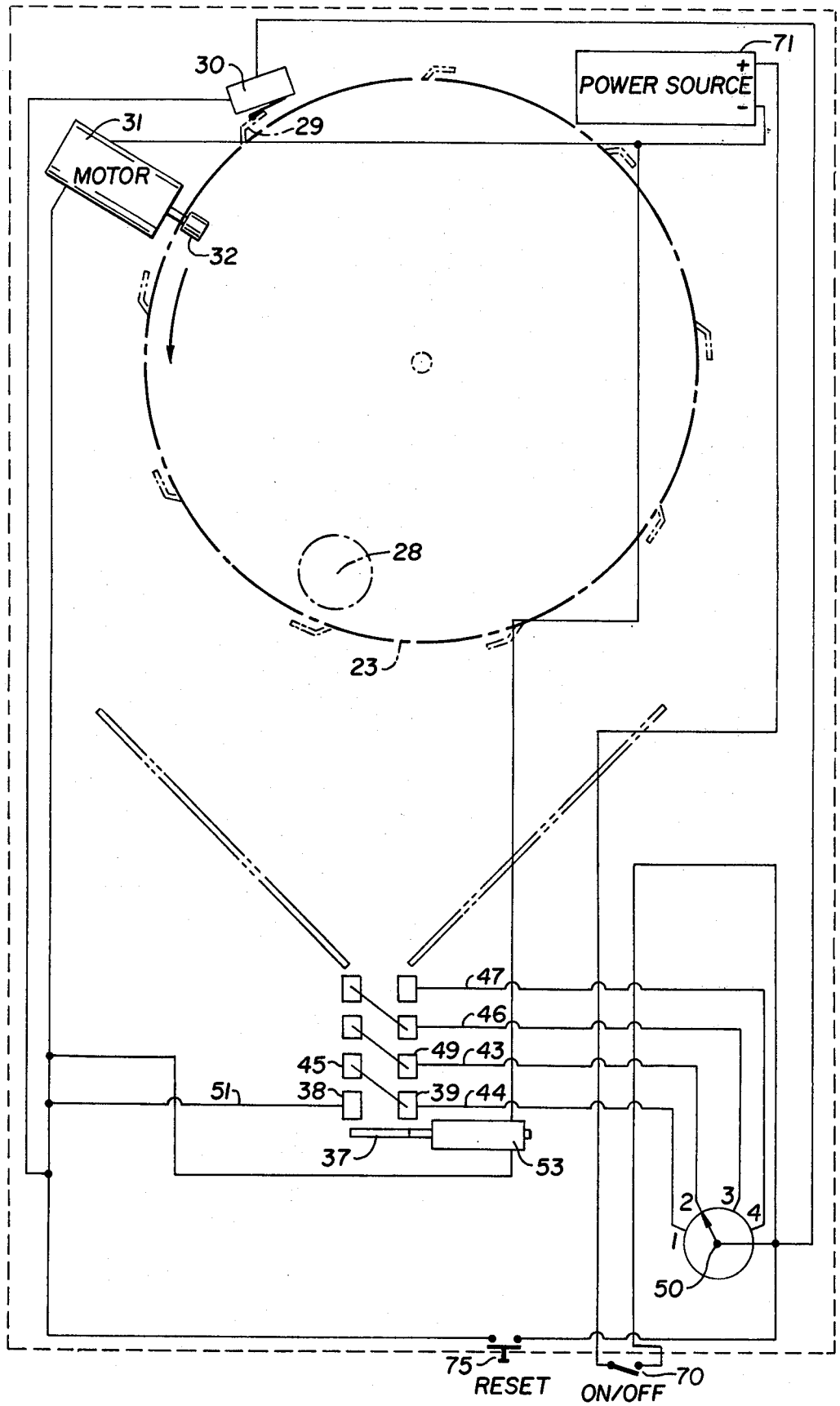
FIG. 3 is schematic circuit diagram showing the functional elements of the circuit at their general respective locations within the game device.

At the initiation of play the balls rest in the channel past the gate 37 and are ready to be lifted to the playing surface. Referring to FIG. 3, an open circuit exists between a power source 71, such as a battery, and drive motor 31, as well as between the power source and a solenoid 53 connected to gate 37, because there are no electrically conductive balls lying in the ball return channel. Thus, the openings in the circuit exist between plates 45 and 49 and between plates 38 and 39. Also at the initiation of play, the disk 23 is positioned so that opening 28 is located below hole 20. Thus cover member 19 is in the open position. At this position of the disk, the cam 29 contacts the switch 30 to permit an additional open circuit between the power source 71 and the motor 31 as well as between the power source and the solenoid. Referring to FIG. 3, it can be seen that the switch 30 is electrically coupled in parallel with the rotary switch 50 and the plates of the ball return channel. Thus, there are two alternate potential paths of power from the battery to the motor and the solenoid. At the initiation of play, these two electrical paths are both open. The first path, through the rotary switch and the plates of the ball return channel, has openings due to the gaps between the plates. The second path has an opening within the switch 30 caused by the activation of the switch by the cam 29 of the disk.

Play begins when the first player lifts the first ball to the surface and propels it up the inclined surface in an attempt to place it through the aperture 20. It should be especially noted that because the other apertures are closed by the cover members, there are no additional hazards for the path of the ball. Should the player miss on the first shot, he continues shooting until the ball passes through the aperture. The number of shots required to place the ball through aperture 20 is then that player's score for the first hole. After the ball has passed through the aperture 20, it will be guided by guide means 36 into the ball return channel and come to rest between plates 38 and 39 because of the closed gate 37. Because the rotary switch was preselected for two players, one ball alone residing in the ball return channel will not complete the circuit since an additional opening in that circuit exists between plates 45 and 49.

The second player then lifts the second ball to the surface and shoots it up the inclined surface in an attempt to place it through the same aperture 20. When the second ball has passed through the aperture it too will be guided by guide means 36 and into the ball return channel. It will come to rest between the plates 45 and 49. At this instant, a circuit is completed between the battery 71 and both the motor 31 and the solenoid 30. Thus, simultaneously the drive motor will rotate the disk and the solenoid will retract, opening the gate and releasing the balls. The rotation of the platform immediately moves the cam 29 away from the switch 30 thus completing the circuit and providing an additional path for power to the motor and solenoid. The movement of the gate caused by the activation of the solenoid will immediately release the balls and thus open that alternate electrical path. However, it will be noted that while this particular electrical path, i.e. the rotary switch and the plates of the ball return channel, is now open, the alternate path through the switch 30 is now closed so that power will continue to flow to the motor and the solenoid. The disk will continue to rotate and the solenoid will continue to hold the gate open. The disk rotates until the next successive cam contacts the switch 30 to thus once again open the circuit. At this time, the motor will stop and the solenoid will once again extend to close the ball return channel. The balls have now passed to the ball lifting mechanism 55 and can be returned one at a time to the playing surface by lever 60 for replay. The rotation of the disk has closed aperture 20 and permitted cover member 22 to open the next aperture. Thus, the two players are now ready to play the second hole.

In addition to the two alternate paths between the power source and the motor and solenoid, a third path is provided by a reset circuit containing a manually operated circuit breaker, such as reset button 75. Thus, in the event the players wish to establish a rule limiting the number of shots to be allowed on a hole, the reset button can be manually activated to provide power to the motor and solenoid. Activation of the reset button permits the return of the balls and the automatic advance of the disk to the next hole.

Thus, it is apparent that the present invention permits the realistic simulation of a game such as golf, in which a variable number of players shoot a ball through a series of holes in turn. After the preselected number of players has finished a particular hole, the device automatically returns the balls, presents the next hole in the series to be played, and covers the played hole to permit the unimpeded travel of the balls toward the newly opened hole.

While the preferred embodiment of the present invention has been illustrated in detail, it is apparent that modifications and adaptations of that embodiment will occur to those skilled in the art. For example, the game device could be suitably constructed to simulate supermarket shopping, rather than golf. Thus, the playing surface would represent a supermarket and each of the holes would depict a particular item to be purchased, e.g. cans of fruit, vegetables, etc. Each shot toward a hole would represent a fixed amount of money toward the purchase price of the item depicted by that hole. The winner is the "best shopper," i.e. the player who finishes all the holes having taken the fewest shots and thus "spent the least." However, it is to be expressly understood that such modifications and adaptations are within the sphere and scope of the present invention.

I claim:

1. A game device comprising in combination:

(a) a plurality of playing balls having electrically conductive surfaces;

(b) an inclined playing surface having a plurality of ball receiving apertures;

(c) a like plurality of cover members releasably disposed within respective apertures;

(d) means for selecting the number of balls to be played;

(e) means for propelling said selected number of balls up said inclined surface toward an aperture; and (f) means for selectively operating said cover members, said operating means including electrically conductive means removed from said apertures and having a plurality of nonelectrically conductive spaces for receiving the balls which have passed through one of said apertures, said electrically conductive means being responsive to the number of balls received in said spaces.

2. A game device comprising in combination:

(a) a plurality of playing balls having electrically conductive surfaces;

(b) an inclined playing surface having a plurality of ball receiving apertures;

(c) a like plurality of cover members releasably disposed within respective apertures;

(d) means for selecting the number of balls to be played;

(e) means for propelling said selected number of balls up said inclined surface toward an aperture; and (f) means responsive to said selected number of balls for selectively operating said cover members, wherein said operating means further comprises a rotatable disk having at least one opening and a plurality of cams on the periphery, means for rotating said disk, an electrical power source for powering said rotating means, a first means interposed between said power source and said rotating means for conducting electric current to said rotating means, said first conducting means having a plurality of non-conductive spaces for the receipt of said balls, and a second means interposed between said power source and said rotating means for conducting electric current to said rotating means, said second conducting means including a switch responsive to contact by said cams.

3. A device according to claim 2 including a third means interposed between said power source and said rotating means for conducting electric current to said rotating means, said third conducting means having a circuit breaker responsive to manual movement.

4. A device according to claim 3 wherein said rotating means further comprises an electric motor operatively coupled to said disk.

5. A device according to claim 2 wherein said selecting means further comprises means electrically coupled to said first conducting means for determining which of said spaces are to receive said balls.

6. A device according to claim 2 including means for releasing said balls from said spaces.

7. A device according to claim 6 wherein said releasing means is a solenoid electrically coupled to said power source.

8. A game device comprising in combination:

(a) an inclined playing surface having a plurality of ball receiving apertures;

(b) a like plurality of movable cover members for opening and closing said apertures;

(c) hinge means connecting each of said cover members to said playing surface in proximity to respective apertures;
(d) means for propelling playing balls having electrically conductive surfaces up said inclined surface;
(e) means for aiming said propelling means to direct said balls toward said apertures;
(f) a rotatable platform mounted beneath said playing surface for retaining said cover members in a closed position, said platform having at least one opening permitting a cover member to open a respective aperture;
(g) a circuit including means for rotating said platform when a preselected number of balls have been played, means for releasing said played balls to be replayed, and means for stopping the rotation of said platform; and
(h) means for returning said played balls to said propelling means.

9. A device according to claim 8 wherein said circuit further comprises:
(a) a power source;
(b) a first switch for selecting the number of balls to be played;
(c) playing balls having electrically conductive surfaces;
(d) a channel having a movable gate for retaining the played balls, said channel having a plurality of pairs of electrically conductive plates, each of said pair defining a space within said channel for the receipt of one of said balls;
(e) an actuator connected to said movable gate for releasing the played balls to be replayed;
(f) a motor for rotating said platform; and
(g) a second switch for stopping the rotation of said platform.

10. A device according to claim 9 wherein said platform is a circular disk having cams located on the periphery, and wherein said second switch is located in close proximity to the periphery of said disk for activation by said cams to open and close said circuit when said disk is rotated.

11. A game device simulating a golf game and capable of being played by one to four players wherein a ball is propelled up an inclined playing surface and through a first hole of a series of holes, and wherein when each of the players has succeeded in placing a ball through the first hole, that hole is automatically closed, the next hole is automatically opened, and the played balls are automatically returned to the playing surface for replay, said device comprising:
(a) an inclined substantially planar playing surface having a plurality of ball receiving apertures;
(b) a like plurality of weighted movable cover members, each of said cover members being loosely disposed in a respective aperture and connected to said playing surface by a hinge device;
(c) a rotatable disk mounted beneath said playing surface for retaining said cover members in a closed position to cover said apertures and having an opening for permitting a cover member to fall into the open position when the disk is rotated to align the opening with a cover member, said disk having a plurality of cams located around the periphery;
(d) at least four balls having electrically conductive surfaces;
(e) a rotatable spring device including means for propelling said balls up said inclined playing surface and means for aiming said balls toward said apertures;
(f) an electrical power source;
(g) means for selecting the number of balls to be played;
(h) a channel for retaining said selected number of balls having been played, said channel further comprising a movable gate for stopping the movement of said selected number of balls, and at least four pairs of electrically conductive plates, each of said pairs defining a space for the retention of one of said balls, said spaces defining gaps in an electric circuit;
(i) a motor for rotating said disk when said selected number of balls is retained in said channel to close an open cover member and open another cover member of said plurality of cover members;
(j) a solenoid connected to said gate for opening said gate when said selected number of balls is retained in said channel;
(k) a switch located in close proximity to the periphery of said disk for stopping the rotation of said disk when said switch is contacted by one of said cams; and
(l) lifting means for returning said selected number of balls to said ball propelling means.

* * * * *